United States Patent [19]

Elkaim

[11] 4,034,573

[45] July 12, 1977

[54] COMPOSITE ARTICLE FORMED BY SUPERPOSED SHAPES OF TWO MEMBERS

[76] Inventor: Henri Elkaim, 5 Rue de Quatre Fages, Paris, France, 75005

[21] Appl. No.: 640,657

[22] Filed: Dec. 15, 1975

[51] Int. Cl.[2] ..... A44C 25/00

[52] U.S. Cl. ..... 63/31

[58] Field of Search ..... 63/31, 23, 1 R, 2; D45/17; 46/31, 23, 1 R, 2

[56] References Cited

U.S. PATENT DOCUMENTS

| | | | |
|---|---|---|---|
| 1,486,753 | 3/1924 | Hynds | 63/2 UX |
| 1,575,419 | 3/1926 | Doyle | 63/31 UX |
| 1,894,195 | 1/1933 | Pulver | 63/2 X |
| 2,224,721 | 12/1940 | Chernow | 63/2 X |
| 3,381,495 | 5/1968 | Emerson | 63/31 X |
| D. 216,371 | 12/1969 | Winchell | 45/17 |

FOREIGN PATENT DOCUMENTS

| | | | |
|---|---|---|---|
| 261,098 | 9/1963 | Australia | 63/2 |

*Primary Examiner*—F. Barry Shay

*Attorney, Agent, or Firm*—Nilsson, Robbins, Dalgarn & Berliner

[57] ABSTRACT

An ornament which consists of at least two members suspended from a necklace, wristlet or similar retaining member. Each of the two members is movable relative to the retaining member as a result of a loop or ring affixed to each of the various members and through which the retaining member passes. Various combinations of geometric configuration are disclosed.

3 Claims, 7 Drawing Figures

COMPOSITE ARTICLE FORMED BY SUPERPOSED SHAPES OF TWO MEMBERS

BACKGROUND OF THE INVENTION

Many articles have been constructed which incorporate moveable members as a portion thereof and which when superimposed one upon the other provide a composite symbol, ornament, novelty, series of letters or numbers, or the like. Such prior art articles known to applicant however are constructed in such a manner that the individual pieces thereof are permanently affixed together about a pre-determined pivot point or if they are not fixed together do not provide a composite appearance when superimposed. The best prior art known to applicant includes U.S. Pat. Nos. 3,381,495, 2,140,594, Des 168,276, Des 167,275, and Australian Patent No. 261,098.

SUMMARY OF THE INVENTION

An article comprising first and second members having principal shapes each having means defining an opening affixed thereto. Retaining means passes through the opening in each of said means defining an opening to retain said members thereon, but leaving said members free to move with respect to said retaining means. Each of the members comprises a part of a composite article formed by their superimposed principal shapes when each of the members is aligned beneath the means defining an opening and when the means defining an opening are in juxtaposition.

DETAILED DESCRIPTION OF THE VARIOUS EMBODIMENTS

Through utilization of the suspension system constructed in accordance with the principles of the present invention a composite article may be constructed which provides a number of features not heretofore obtainable in prior art structures. For example an article constructed in accordance with the present invention may have the elements forming the composite structure each individually moveable with respect to each other and with respect to the necklace, wristlet or other means of suspension or retention incorporated therewith. Yet, when held together through the forces of gravity, the composite structure with the desired appearance formed by the superimposed principal shapes of the elements is obtained. In addition one may purchase individual component parts utilizing the suspension system constructed in accordance with the present invention and by assembling each of the individual component parts together upon a retaining means may achieve any desired composite structure giving an impression different from that previously obtained. With such capability, each wearer of the article may create his own unique structure. Alternatively, one may purchase several individual composite articles and then as, a result of the utilization of the unique suspension system in accordance with the present invention, may mix or match various of the individual components of each of the articles as purchased again realizing the unique composite structure originated by the individual wearer as he desired. By way of example only, various such possibilities are illustrated in the accompanying drawings to which reference is now made.

Figure 1:
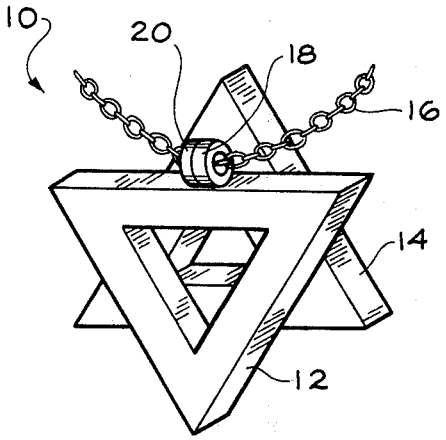
FIG. 1 is a rear perspective view of one embodiment of an article manufactured in accordance with the principles of the present invention.
Figure 2:
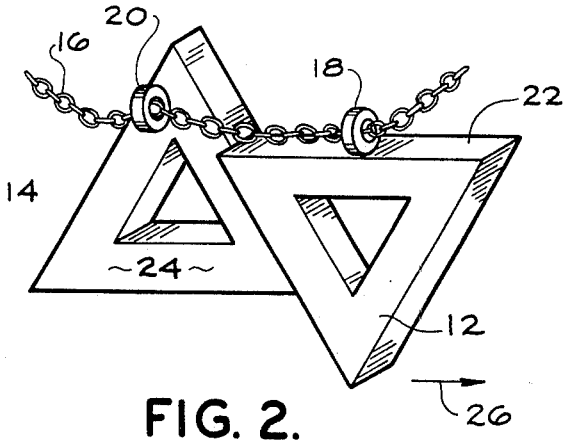
FIG. 2 illustrates the article of FIG. 1 but showing the individual portions thereof as being slidable along a retaining means.
Figure 3:
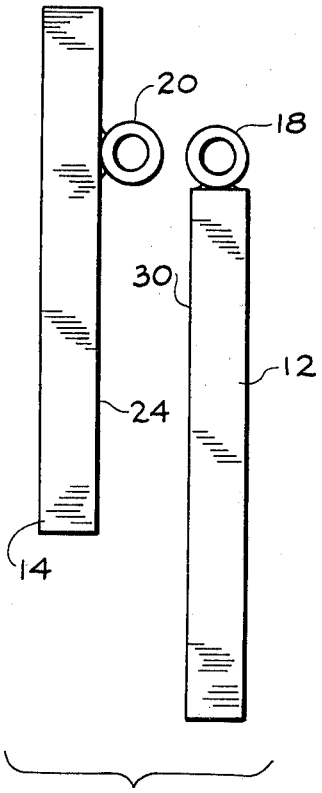
FIG. 3 is a side view of the article illustrated in FIG. 1 illustrating in further detail the construction thereof.

Referring first to FIGS. 1 through 3 there is illustrated a composite article 10 having two non-perforate or solid elements 12 and 14 which when placed upon a retaining means 16 and held together by the forces of gravity takes the form of a STAR OF DAVID. Each of the elements 12 and 14 includes a means for defining an opening 18 and 20 respectively. In the structure as illustrated in FIGS. 1 through 3 the means for defining an opening takes the form of a tab in the shape of a ring which is permanently affixed to each of the members 12 and 14.

Each of the members 12 and 14 in FIGS. 1 through 3 is in the form of an equilateral triangle. The triangle 12 has the ring 18 affixed to a minor surface such as an edge 22 thereof with the opening in the ring 18 disposed longitudinally of the edge 22. The triangle 14 includes a major surface 24 which defines the principal shape of the triangle with the ring 20 affixed to that surface in such a manner that the opening in the ring 20 is disposed along the surface 24. It will be noted that the minor surface is at an angle to the major surface. In addition thereto as will be noted particularly in FIG. 2 the ring 20 is displaced inwardly from the outer surface edges of the triangle 14.

As a result of the manner in which the rings 18 and 20 are affixed to the triangles 12 and 14 respectively, when the two rings 18 and 20 are in juxtaposition the triangles 12 and 14 are caused to be superimposed one upon the other so that a viewer will receive the impression of a STAR OF DAVID. The wearer of the article may manipulate each of the triangles 12 and 14 as desired by moving the same individually or together along the retaining means such as the necklace 16 as is illustrated by the arrows 26 and 28 in FIG. 2. Such illustrates that each of the triangles 12 and 14 is a separate component of the article 10 and is moveable or removable individually with respect to each other and with respect to the retainer means 16.

If desired the rings 18 and 20 may be separate pieces which are welded, soldered, brazed or otherwise affixed to the to the triangles 12 and 14 respectively. Alternatively, depending upon the method of construction of the triangles 12 and 14 the rings 18 and 20 may be formed unitarily with the triangles 12 and 14 respectively.

By reference particularly to FIG. 3 it will be noted that the width of the rings 18 and 20 is the same as the thickness of the triangles 12 and 14. Through utilization of this type of structure, when the rings 18 and 20 are in juxtaposition the surfaces 24 and 30 are in contact one with the other and by positioning the rings 18 and 20 with respect to the edge portion 22 and the surface portion 24 as above described the triangles will lie flat against the chest of a wearer when the retaining means 16 is in the form of a necklace and is worn about the neck of the wearer.

Figure 4:
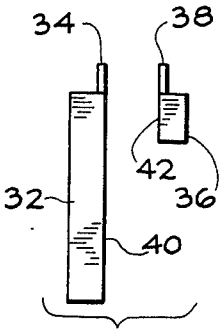
FIG. 4 is a side view of an article showing an alternative means of construction thereof.

Under some circumstances it may be desired that the particular component parts not lie flat or that they be brought together in a fashion such that a different alignment of the openings is accomplished. An illustration in side elevation of an ornament having such a structure is found in FIG. 4. As is therein shown an element 32 has a loop defining means 34 connected thereto on a minor surface thereof while an element 36 has a loop defining means 38 connected thereto also on a minor surface thereof. The loops 34 and 38 are positioned with respect to the elements 32 and 36 respectively in such a way that the openings defined are not visible as illustrated in FIG. 4. It should also be noted that the loop 34 is positioned to one edge of the element 32 while the loop 38 is positioned also to one edge of the element 36. In this fashion, the two loops may be placed in juxtaposition and worn with the surfaces 40 and 42 together to provide the desired impression.

Figure 7:
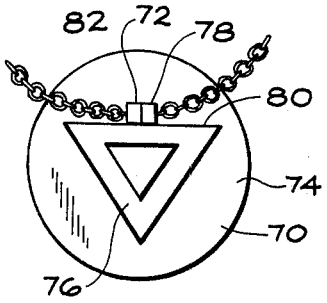
FIG. 7 is a front elevational view showing another alternative embodiment of an article constructed in accordance with the principles of the present invention.
Figure 6:
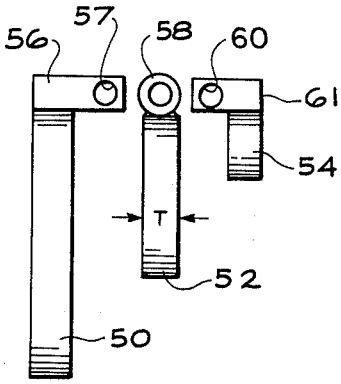
FIG. 6 is a side view of the article illustrated in FIG. 5 showing in further detail the construction thereof.
Figure 5:
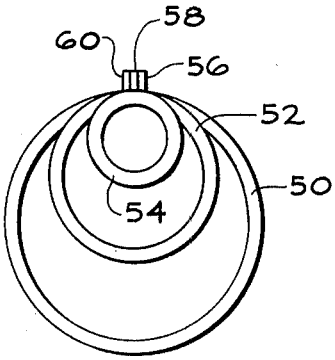
FIG. 5 is a front elevational view of an alternative embodiment of an article constructed in accordance with the principles of the present invention.

Any article desired may have more than two components to provide the desired composite impressions. Referring now more specifically to FIGS. 5 and 6 one such ornament is shown for purposes of illustration only. As is illustrated in FIGS. 5 and 6 three rings 50, 52 and 54 each of different size are illustrated as forming a composite article. Each of the rings has an opening defining means affixed thereto on a minor surface thereof as is illustrated at 56, 58 and 60 respectively. As is shown more specifically in FIG. 6 the ring 50 includes a tab 56 affixed thereto with an opening 57 defined therein. It should be noted that the opening 57 is offset toward the right (as viewed in FIG. 6) from the ring 50. The ring 52 includes an opening defining means 58 very similar to the rings as illustrated in FIGS. 1 through 3. The ring 54 has a tab 60 affixed thereto and is disposed in such a manner that the opening 61 defined thereby is offset to the left (as viewed in FIG. 6) from the ring 54. It should also be noted that the offset portions of the tabs 56 and 60 are of the same dimension as is the thickness "T" of the ring 52. By this construction, when the rings 50, 52 and 54 are superimposed one upon the other with the tabs 56, 58 and 60 in juxtaposition the composite ornament as shown in FIG. 5 is obtained and will lie flat against the chest of the wearer. Again, it will be recognized that each of the rings may be moved along a necklace or the like. A still further alternative embodiment showing the capability of mixing various of the elements to obtain a desired composite article is shown in FIG. 7 to which reference is hereby made. As is illustrated in FIG. 7 a circular solid plate 70 having an opening defining means 72 affixed to the front surface thereof is provided. Also provided is an open centered triangle 76 having an opening defining means 78 affixed to an edge 80 thereof. The openings in the opening defining means 72 and 78 are positioned and disposed similar to that illustrated in FIGS. 1 through 3. A retaining means in the form of a necklace 82 passes through the openings to suspend the components 70 and 76 in a manner similar to that previously described.

By referring to each of the composite structures as illustrated in the drawings and as above described it will now become apparent to those skilled in the art that when each of the components forming the composite article is freely suspended upon is retaining means the center of gravity thereof is positioned immediately beneath the opening defining means affixed thereto to thus position each of the components to provide the desired composite structural appearance. By appropriately offsetting the openings in any desired direction by a desired amount one may obtain different appearance such as an even greater three dimensional effect to a particular composite article than is obtained when the various components of the ornament have adjacent surfaces in contact. Likewise, by offsetting the openings to one side of the physical center thereof the article will hang in such a way as to provide a different appearance as desired.

What is claimed is:

1. Article of manufacture comprising:

A. a first member having a major surface defining the principal shape of said member and a minor surface at an angle to said major surface and defining an edge portion;

B. First tab means permanently affixed to said edge portion and defining an opening therethrough having its axis aligned longitudinally of said edge portion;

C. A second member having a major surface defining the principal shape of said member and a minor surface at an angle to said major surface and defining an edge portion;

D. Second tab means permanently affixed to one of said surfaces of said second member and defining an opening generally aligned therealong;

E. A single longitudinal retaining means passing through the opening in each of said first and second tab means, said members each being free to move with respect to said retaining means and with respect to each other so that they may occupy mutually spaced positions thereon;

F. Each of said first and second members being a part of a composite article formed by their superimposed principal shapes when each said member is aligned beneath the tab means affixed thereto and said tab means are in juxtaposition.

2. An article as defined in claim 1 wherein said second tab means is inwardly displaced from the outer edge of said second member.

3. An article as defined in claim 2 wherein said first and second members are equilateral triangles forming a composite Star of David.

* * * * *